US006074237A

United States Patent [19]

Lee

[11] Patent Number: 6,074,237

[45] Date of Patent: Jun. 13, 2000

[54] ELECTRICAL CONNECTOR ASSEMBLY

[75] Inventor: George Lee, Taipei, Taiwan

[73] Assignee: Hon Hai Precision Ind. Co., Ltd., Taipei Hsien, Taiwan

[21] Appl. No.: 09/416,485

[22] Filed: Oct. 12, 1999

[30] Foreign Application Priority Data

Jun. 15, 1999 [TW] Taiwan ..... 88209851

[51] Int. Cl.[7] ..... H01R 4/24

[52] U.S. Cl. ..... 439/405; 439/358

[58] Field of Search ..... 439/357, 358, 439/404, 405, 417, 435, 456, 459, 470, 492, 499

[56] References Cited

U.S. PATENT DOCUMENTS

| | | | |
|---|---|---|---|
| 4,006,957 | 2/1977 | Narozny . | |
| 4,359,257 | 11/1982 | Lopinski t al. . | |
| 4,621,885 | 11/1986 | Sczesny et al. . | |
| 4,648,677 | 3/1987 | Lang | 439/459 |
| 4,960,390 | 10/1990 | Davis et al. | 439/459 |
| 5,108,308 | 4/1992 | Wellinsky | 439/404 |
| 5,125,850 | 6/1992 | Locati | 439/404 |
| 5,338,221 | 8/1994 | Bowen et al. | 439/405 |
| 5,664,961 | 9/1997 | Tsuji et al. | 439/358 |
| 5,762,515 | 6/1998 | Stine | 439/358 |

*Primary Examiner*—Gary F. Paumen
*Attorney, Agent, or Firm*—Wei Te Chung

[57] ABSTRACT

An insulation displacement connector (IDC) assembly comprises a header member for being fixed to a circuit board and retaining a plurality of pins therein, a socket member having a pair of engaging portions and retaining a plurality of terminals having piercing portions for terminating a flat flexible cable, a termination cover for pressing the cable to engage with the piercing portions of the terminals and forming a pair of engaging members for engaging with the corresponding engaging portions of the socket member, and a latching member having a pair of latching devices for securing a subassembly of the termination cover and the socket member to the header member. Each engaging portion of the socket member forms upper latching bars and a lower detent for engaging with the corresponding engaging member of the termination cover in two separate steps, whereby a preferable type of flat flexible cable may be selected to be terminated with the IDC assembly.

1 Claim, 8 Drawing Sheets

ELECTRICAL CONNECTOR ASSEMBLY

BACKGROUND OF THE INVENTION

The present invention relates to an electrical connector assembly, and particularly to an insulation displacing electrical connector assembly which can easily engage with and disengage from a circuit board and can be manufactured at a low cost.

A conventional connector for terminating multi-conductor flat flexible cable is disclosed in U.S. Pat. No. 4,359,257. The conventional connector comprises an elongate housing member having a plurality terminals with piercing portions for terminating conductive wires of the flat cable, and an elongate cover for pressing and securing the flat cable to the piercing portions of the terminals. The cover comprises a U-shaped latching member extending from each end thereof and including a pair of spaced leg portions joined at one end by a crossbar. A trap is defined in each end of the housing and communicates with an outwardly directed latching channel. A latching lug is formed in the channel of the housing. After the flat cable is disposed between the cover and the housing, each latching member of the cover is inserted into the trap of the housing toward the corresponding channel. The crossbar of each latching member is pushed to overcome the latching lug and interferentially engage with a bottom surface of the latching lug whereby the cover presses and secures the flat cable between the cover and the IDC terminals of the housing.

Another pertinent conventional connector is disclosed in U.S. Pat. No. 5,125,850. The conventional connector comprises a connector housing, a termination cover, and a strain relief member. The housing forms a pair of towers on opposite ends thereof and an outwardly protruding detent on each tower. The cover has a fluted bottom portion and a smooth top surface. A first crossing member is flanked on each side of the cover by downwardly extending U-shaped guiding slots. The strain relief member has a second crossing member flanked on each side by downwardly extending end walls which are divided at the bottom to form two pairs of latch arms which contain outwardly protruding detents. In assembly, the termination cover is pressed onto the housing thereby terminating the cable disposed therebetween. The stain relief member is then pressed toward the termination cover and the housing. As the strain relief member moves closer, each pair of latch arms simultaneously bends inwardly. The second crossing member of the strain relief member also bows slightly. Continued movement causes the towers to diverge outwardly. Finally, the towers and the latch arms resile thereby latching the strain relief member onto the housing.

After the latching members of the housing are positioned within the channels of the cover, the flat cable is secured between the housing and the cover, and pierced by the piercing portions of the terminals. Thus, only one flat cable can be used. No additional flat cables can be selected to replace the original flat cable terminated to the connector when the original flat cable suffers damages. If another flat cable is required, another connector terminating the desired type of flat cable must be purchased. Therefore, an improved connector which can fulfil the requirements of freely-replacing a flat cable is in demand.

BRIEF SUMMARY OF THE INVENTION

A main object of the present invention is to provide an insulation displacement connector (IDC) assembly which can selectively terminate a desired flat cable.

Another object of the present invention is to provide an IDC assembly which can easily engage with and disengage from a circuit board.

Another object of the present invention is to provide an IDC assembly which can be easily manufactured at a low cost.

An IDC assembly in accordance with the present invention comprises a header member fixed to a circuit board and retaining a plurality of pins therein, a socket member mounting a plurality of terminals, a termination cover for pressing and securing a flat flexible cable between the socket member and the termination cover, and a latching member for securing a subassembly of the socket member and the termination member to the header member.

The resilient latching member comprises a handle portion for facilitating manual operation, and a pair of latching devices outwardly extending from opposite ends of the handle portion for securing a subassembly of the termination cover and the socket member to the header member. Each latching device includes a first arm integrally and downwardly extending from the corresponding end of the handle portion, and a second arm joined with the first arm via a ribbed connecting portion. Each first arm forms a first hook at a free end thereof, while each second arm also forms a second hook at a free end thereof proximate the first hook for engaging with the header member. Each second arm further has a pressing button opposite the second hook for facilitating manual operation. The second arms can be inwardly pressed to pivotally deflect about the corresponding connecting portions thereby releasing the subassembly from the header member.

The socket member forms a pair of engaging portions at opposite ends thereof for engaging with corresponding engaging members formed at opposite ends of the termination cover. Each engaging portion comprises a passage defined between a pair of side walls and a crossing member, a pair of latching bars formed on an end wall proximate the crossing member, and a detent below the latching bars. Each engaging member of the termination member comprises a pair of cantilevered beams joined together at ends thereof via a transverse rod and a pair of bumps outwardly protruding from other ends thereof opposite the transverse rod.

Each engaging member of the termination cover can be partially inserted into the corresponding passage of the socket member, and can be pressed to pass over the upper latching bars of the corresponding engaging portion. The transverse rod of the corresponding engaging member abuts against bottom surfaces of the latching bars of the corresponding engaging portion. The terminal cover can be further pressed downwardly to completely engage with the socket member. The transverse rod of each engaging member of the cover is then driven to abut against a bottom surface of the detent of the corresponding engaging portion of the socket member.

The termination cover is partially assembled with the socket member with the engaging members of the termination cover engaging the latching bars of the corresponding engaging portions of the socket member. Thus, a desired flat flexible cable can be selected to be assembled into the IDC assembled.

Other objects, advantages and novel features of the invention will become more apparent from the following detailed description when taken in conjunction with the accompanying drawings.

DETAILED DESCRIPTION OF THE INVENTION

Figure 1:
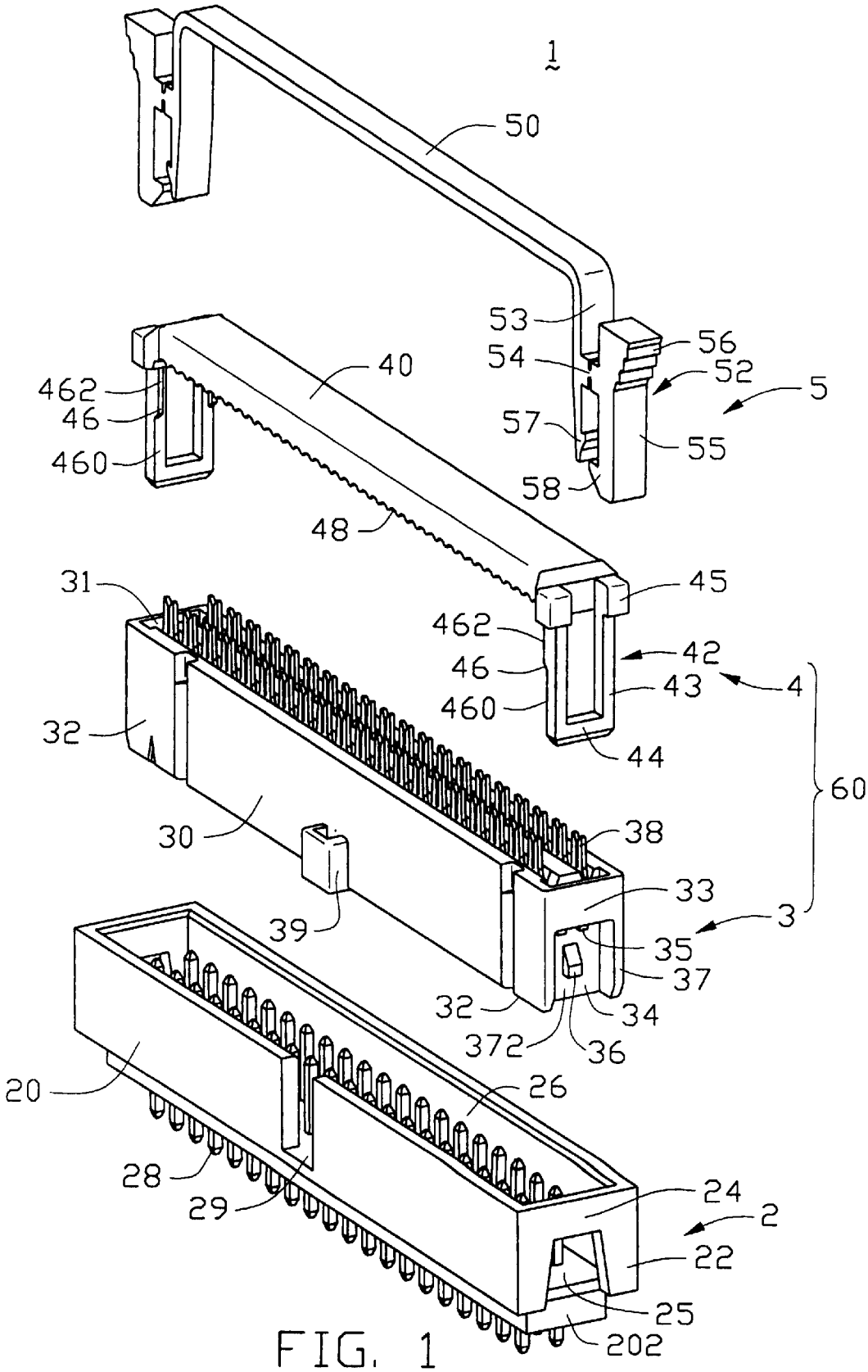
FIG. 1 is an exploded view of an insulation displacement connector assembly of the present invention.
Figure 2:
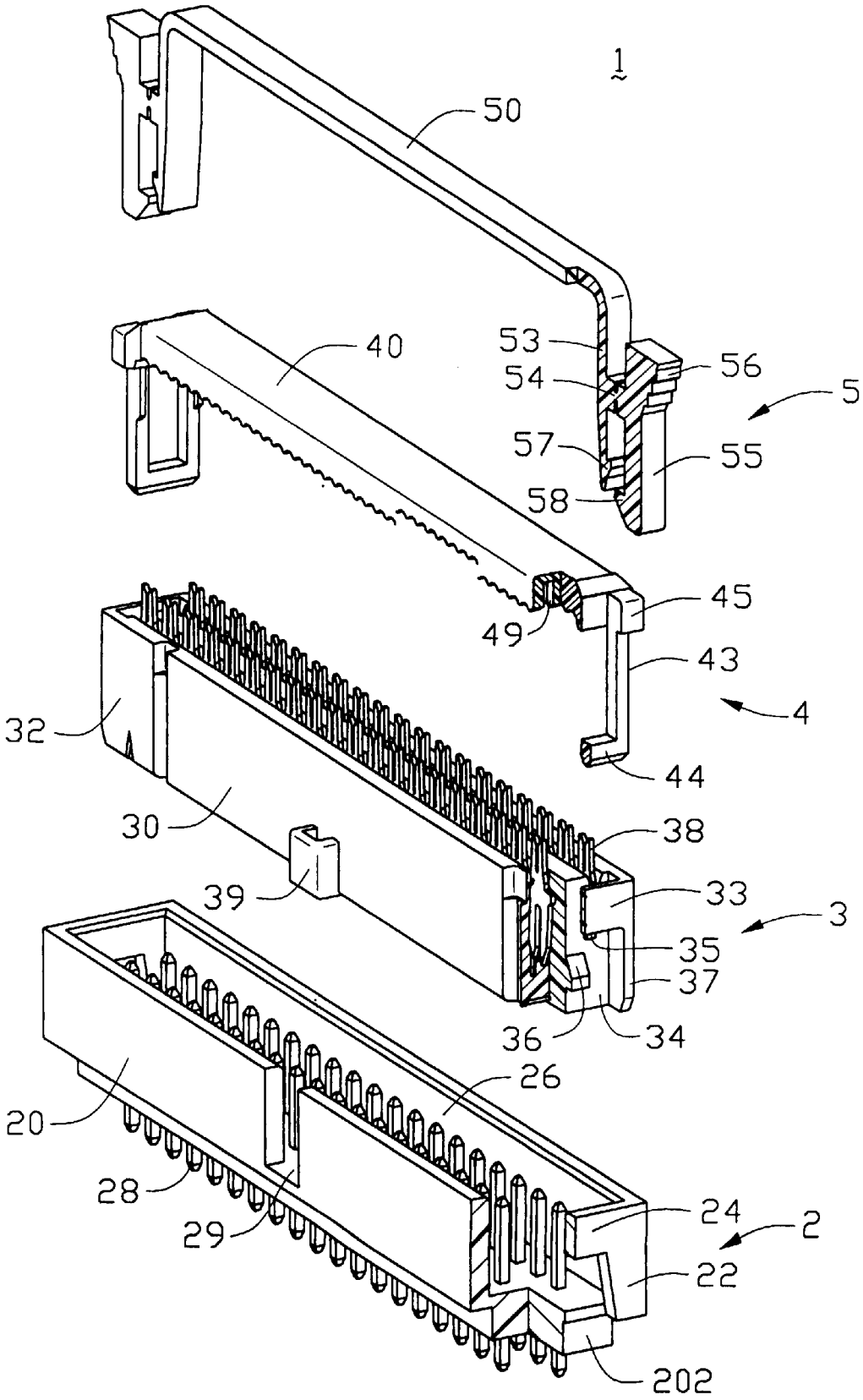
FIG. 2 is a partial cross-sectional view of FIG. 1.
Figure 3:
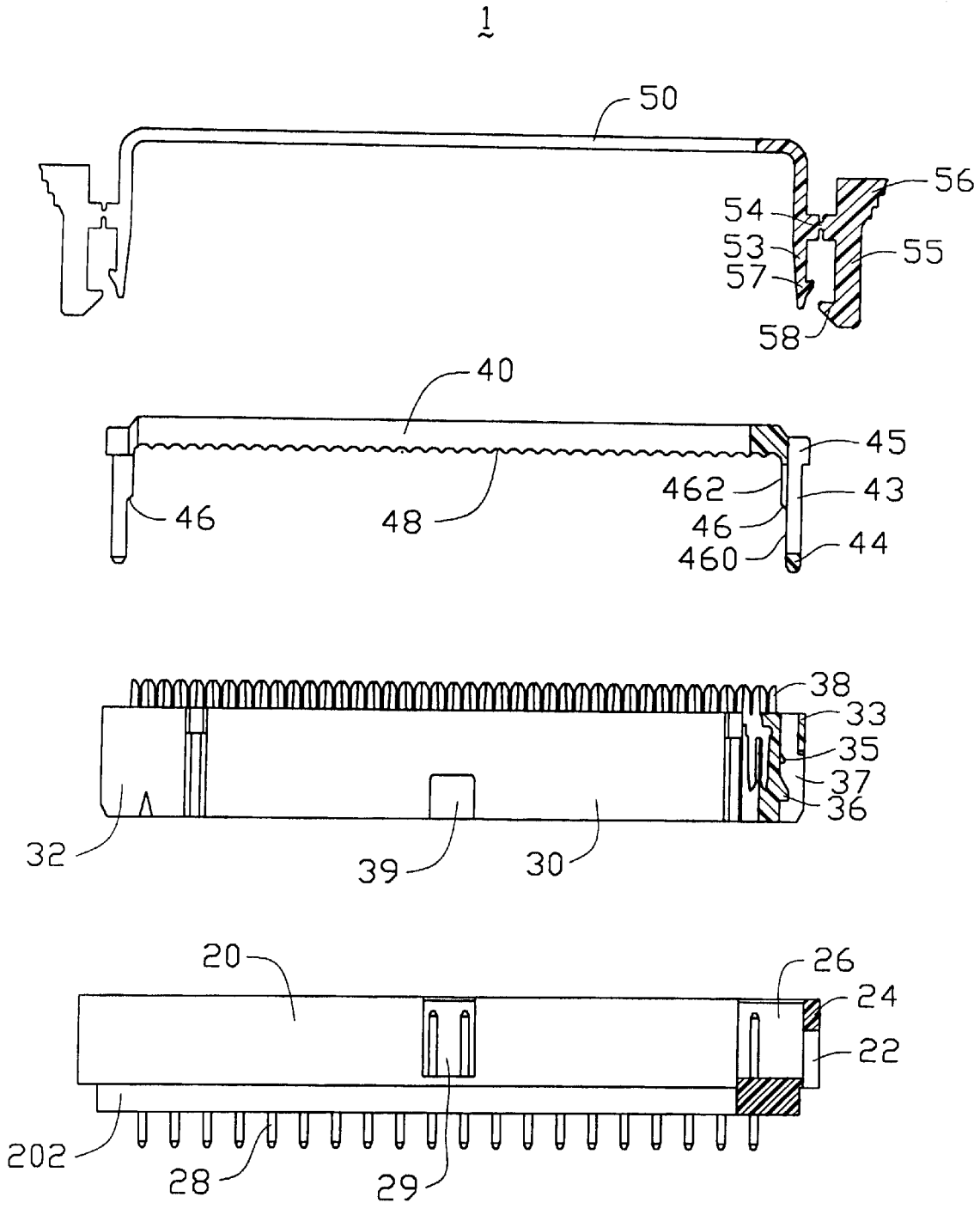
FIG. 3 is a plan view of FIG. 2.

Referring to FIGS. 1, 2 and 3, an insulation displacement (IDC) assembly 1 in accordance with the present invention comprises a header member 2 fixed to a circuit board (not shown), a subassembly 60, and a latching member 5 forming a latching device 52 on each end thereof for releasably latching the subassembly 60 onto the header member 2. The subassembly 60 includes a socket member 3 retaining a plurality of terminals 38 for mating with corresponding pins 28 fixed in the header member 2, and a termination cover 4 forming a pair of engaging members 42 for engaging with the socket member 3.

The header member 2 is elongate and comprises a main body 20, a supporting board 202, and a plurality of the pins 28 fixed in the supporting board 202. The pins 28 upwardly extend into a receiving passageway 26 defined in the main body 20, and downwardly extend for electrically connecting with the circuit board. A cutout 29 is defined in a side wall of the main body 20. A pair of latching portions 22 is formed at opposite ends of the main body 20 for engaging with the latching member 5. Each latching portion 22 comprises a recess 25 and a crossbeam 24 integrally formed with the main body 20.

The socket member 3 comprises an elongate housing member 30 defining two rows of receiving channels 31 therein, a plurality of the terminals 38 received in the corresponding receiving channels 31, and a pair of engaging portions 32 outwardly extending from opposite ends of the housing member 30 for engaging with the termination cover 4. Each engaging portion 32 comprises a pair of latching bars 35 formed on an end wall 372 of the housing member 30, a detent 36 projecting from the end wall 372 below the latching bars 35, and a passage 34 defined by a pair of side walls 37, an end wall 372 of the housing member 30, and a crossing member 33. A projection 39 outwardly extends from a side wall (not labeled) of the housing member 30 for engaging with the cutout 29 of the header member 2.

The termination cover 4 is elongate and comprises a flat cover body 40. A pair of engaging members 42 extends from opposite ends of the cover body 40 for engaging with the corresponding engaging portions 32 of the socket member 3. The cover body 40 defines two rows of slots 49 aligned with the corresponding receiving channels 31 of the socket member 3. A plurality of arcuate recesses 48 is formed in a bottom surface of the cover body 40 corresponding to the terminals 38 of the socket member 3 for receiving a flat flexible cable (not shown) therebetween. Each engaging member 42 comprises a pair of cantilevered arms 43, a transverse rod 44 joining the pair of cantilevered arms 43 for engaging with the corresponding detent 36 of the socket member 3, and a bump 45 on an upper edge of each cantilevered arm 43. A ridge 46 is formed on an inner surface of each cantilevered arm 43 at a junction between a lower step surface 460 and an upper step surface 462 for engaging with the corresponding latching bar 35 of the socket member 3. A horizontal distance between the ridges 46 are substantially equal to a horizontal distance between the latching bars 35. Thus, the ridges 46 of the termination cover 4 can properly engage with the corresponding latching bars 35 of the socket member 3.

The resilient latching member 5 comprises a handle portion 50 and a pair of the latching devices 52 formed on opposite ends of the handle portion 50. Each latching device 52 comprises a first arm 53 downwardly extending from the corresponding end of the handle portion 50, and a second arm 55 extending from the first arm 53 via a connecting portion 54 having grooves 59 formed around a middle point thereof. Each first arm 53 forms a first hook 57 on a free end thereof for latching onto the corresponding crossing member 33 of the socket member 3, while each second arm 55 forms a second hook 58 on a free end thereof for latching onto the corresponding crossbeam 24 of the header member 2. A pressing portion 56 is formed on each second arm 55 opposite the second hook 58 for facilitating manual operation thereof. It is understood that because of the grooves 59, when the second arm 55 is disengaged from the crossbeam 24 of the header member 2, the rotation of the second arm 55 about the connecting portion 54 will be isolated from the first arm 53 and not make the first arm 53 deflected correspondingly, thus assuring the first arm 53 may still keep latchable engagement with the crossing member 33 of the socket member 3. It is also noted that an enough space is formed between the handle portion 50 of the latching member 5 and the cover body 40, thus allowing fingers to extend therethrough and hold the handle portion 50 for removing the subassembly 60 from the header member 2.

Figure 4:
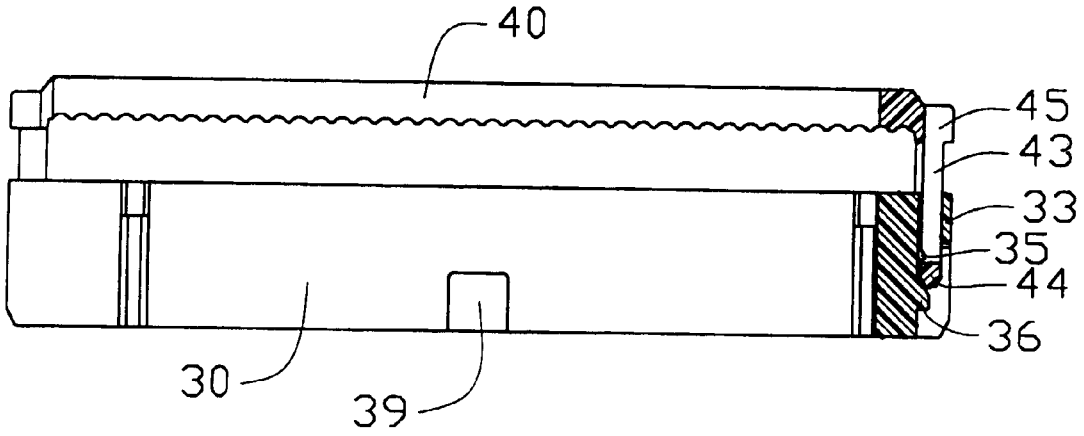
FIG. 4 is a partially assembled view of FIG. 3 showing a socket member and a termination cover.
Figure 5:
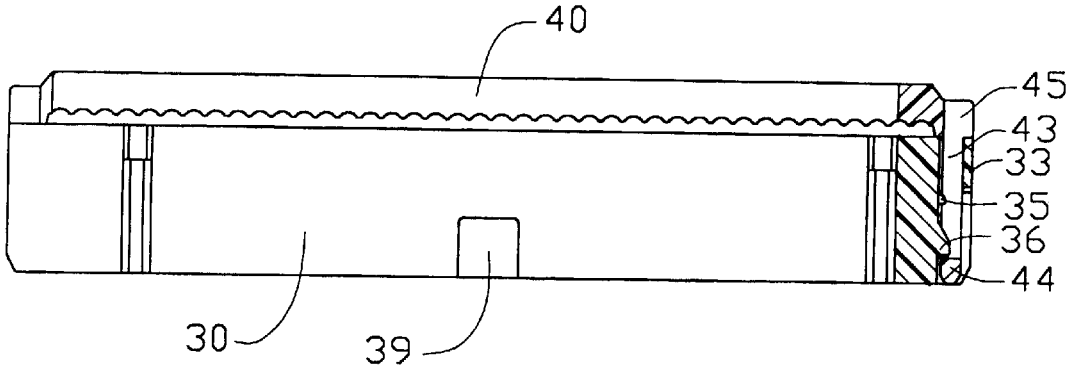
FIG. 5 is a completely assembled view of FIG. 4.

Referring to FIGS. 4 and 5, the terminals 38, the pins 28 and the flat flexible cable are omitted for clearly showing how the termination cover 4 engages with the socket member 3. The engaging members 42 of the termination cover 4 engage with the corresponding engaging portions 32 of the socket member 3 in two steps. Each engaging member 42 is inserted into the passage 34 of the corresponding engaging portion 32. Each latching bar 35 of the engaging portions 32 abuts against the upper step surface 462, while the transverse rod 44 simultaneously abuts against an upper surface of the corresponding detent 36. The transverse rod 44 is then driven to overcome a blocking effect of the detent 36 and passes over the detent 36 to abut against a bottom surface of the detent 36, while each ridge 46 engages with the corresponding latching bar 35 of the engaging portion 32.

Figure 6:
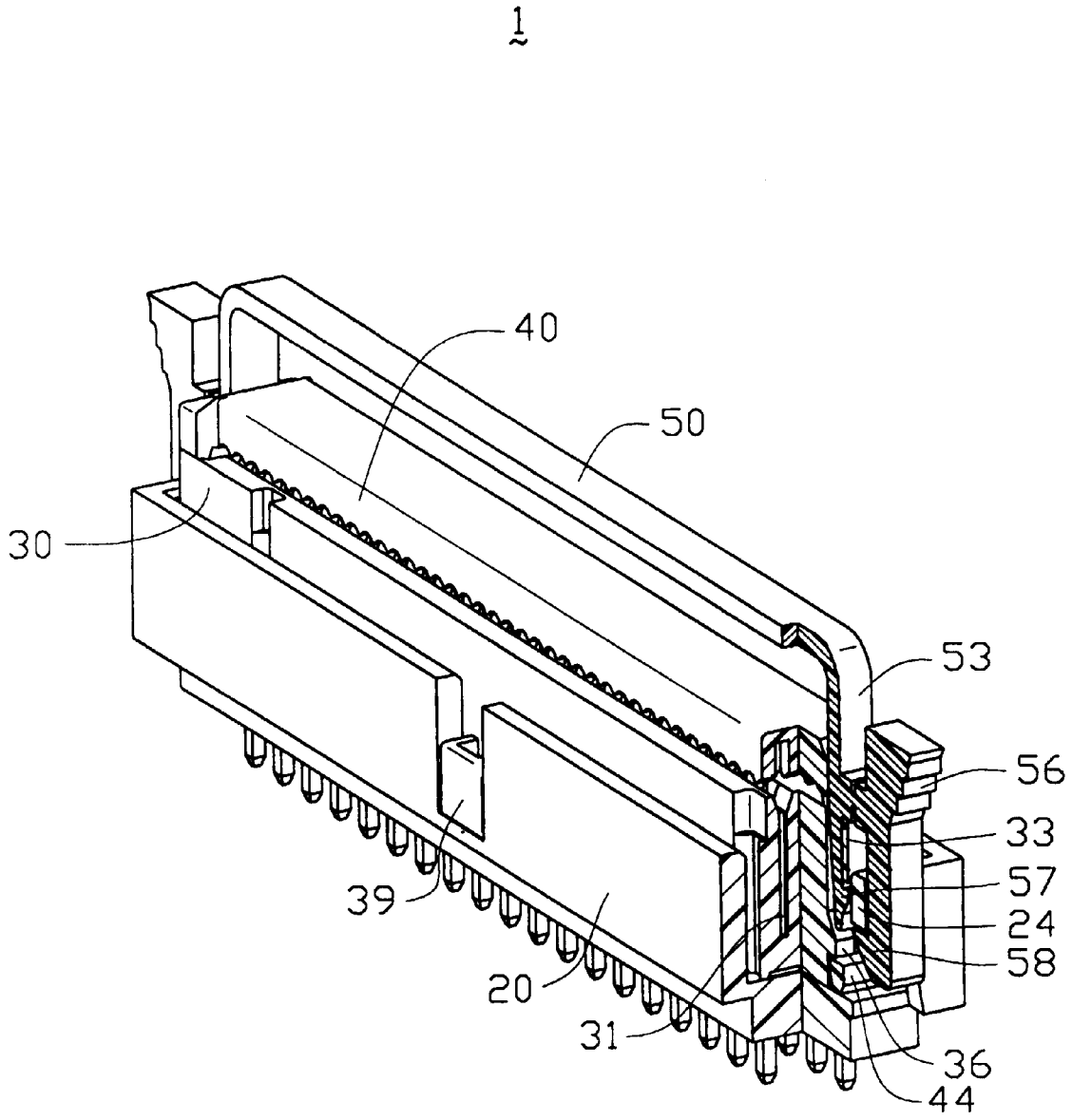
FIG. 6 is a perspective, assembled view of FIG. 2.
Figure 7:
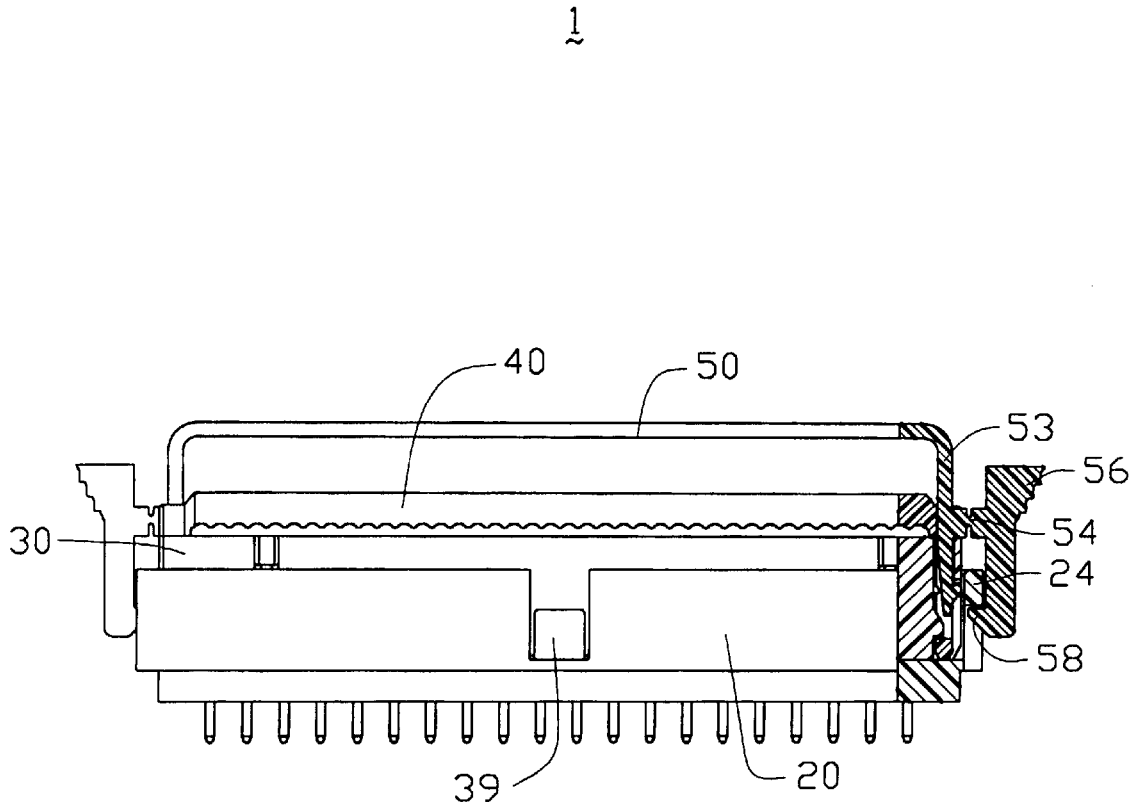
FIG. 7 is a plan view of FIG. 6.
Figure 8:
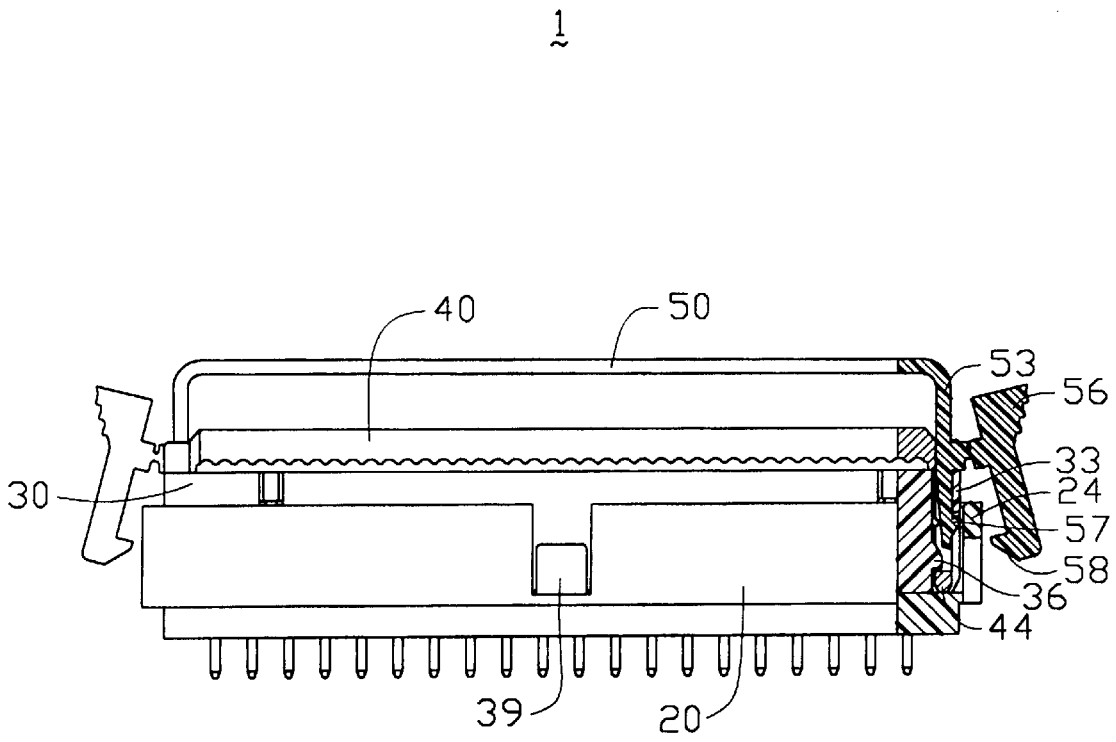
FIG. 8 is similar to FIG. 7 showing how to disengage a subassembly consisting of a latching member, the termination cover, and the socket member from a header member.

Referring further to FIGS. 6, 7 and 8, the 1 first arms 53 of the latching devices 52 of the latching members are inserted into the corresponding passages 34 of the socket member 3, while the first hooks 57 latch onto the corresponding crossing members 33.

The latching member 5 and the subassembly 60 are assembled to the header member 2 whereby the housing body 30 is received in the receiving passageway 26 of the header member 2, while the pins 28 engage with the corresponding terminals 38 of the socket member 3. The projection 39 of the socket member 3 engages within the cutout 29 of the header member 2. The second hooks 58 of the second arms 55 of the latching member 5 latch onto the corresponding crossbeams 24 of the header member 2. Thus, the IDC assembly 1 is completed.

When the termination cover 4 is only partially assembled with the socket member 3, the IDC assembly 1 can fulfil requirements of selecting a desired flat flexible cable to be terminated to the IDC assembly 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An insulation displacement connector assembly comprising:

an elongate header fixed to a circuit board and comprising a main body and a plurality of pins retained in the main body, a receiving passageway being defined in the main body, the pins extending into the receiving passageway for electrically connecting with the circuit board;

a dielectric elongate socket member received in the receiving passageway of the header member, the socket member comprising a housing body, a plurality of terminals received in the housing body and having piercing portions for terminating a flat flexible cable, and a pair of engaging portions outwardly extending from opposite ends of the housing body, each engaging portion comprising a pair of latching bars respectively formed on a corresponding end wall of the housing body, a detent outwardly projecting from each end wall below corresponding latching bars, a crossing member joined with a pair of side walls of the housing body, and a passage defined by the side walls, the end wall and the crossing member;

a dielectric elongate termination cover for positioning and securing the flat flexible cable to the socket member, the termination cover comprising a cover body for pressing the flat flexible cable to engaging with the piercing portions of the terminals of the socket member, and a pair of engaging members downwardly extending from opposite ends of the cover body for extending into corresponding passageways of the socket member, each engaging member of the termination member comprising a pair of downwardly extending cantilevered beams, and a transverse rod joining the cantilevered beams together, each cantilevered beam forming an upper step surface, a lower step surface, and a ridge at a junction between the upper and lower step surfaces for engaging with the corresponding latching bar of the socket member; and a resilient latching member comprising a handle portion for facilitating manual operation thereof, and a pair of latching devices for latching the termination cover and the socket member onto the header member, each latching device comprising a first arm downwardly extending from a lateral end of the handle portion, and a second arm joined with the first arm for engaging with the header member, a connecting portion being formed between the first arm and the second arm for allowing each second arm to be driven to pivotally rotate thereabout;

wherein each latching bar of the socket member abuts against the upper step surface of the corresponding engaging member of the termination cover, while the transverse rod of each engaging member simultaneously abuts against an upper surface of the corresponding detent of the socket member when each engaging member is firstly inserted into the corresponding passage of the socket member; and wherein the transverse rod of each engaging member is then driven to overcome a blocking effect of the detent and passes over the detent to abut against a bottom surface of the detent, while the ridges of each engaging member engage with the corresponding latching bars of the socket member;

wherein a pair of latching portions is formed at opposite ends of the main body of the header member for engaging with the corresponding latching devices, each latching portion forming a crossbeam integrally formed with the main body for engaging with the second arm of the corresponding latching device of the resilient latching member;

wherein the cover body of the termination cover defines a plurality of arcuate recesses corresponding to the terminals for pressing the flat flexible cable to the piercing portions of the corresponding terminals.

* * * * *